United States Patent [19]

Liska et al.

[11] Patent Number: 4,785,997

[45] Date of Patent: Nov. 22, 1988

[54] HYDRAULIC MOTOR FOR USE WITH AIRLESS PAINT SPRAYER SYSTEM

[75] Inventors: Miroslav Liska, Northridge; Anthony Tomsicek, Woodland Hills, both of Calif.

[73] Assignee: Durotech Co., Moorpark, Calif.

[21] Appl. No.: 115,335

[22] Filed: Nov. 2, 1987

[51] Int. Cl.[4] ..... B05B 9/03

[52] U.S. Cl. ..... 239/332; 91/189; 91/321; 239/172

[58] Field of Search ..... 239/146, 172, 332; 91/286, 289, 303, 321, 350

[56] References Cited

U.S. PATENT DOCUMENTS

| | | | |
|---|---|---|---|
| 2,556,680 | 6/1951 | Davis | 91/321 |
| 3,079,900 | 3/1963 | Hunnicutt | 91/321 |
| 3,317,141 | 5/1967 | Mann | 239/332 |
| 4,365,745 | 12/1982 | Beck | 239/332 |
| 4,383,475 | 5/1983 | Quarve | 91/321 |
| 4,684,062 | 8/1987 | Bagwell | 239/332 |

FOREIGN PATENT DOCUMENTS

| | | | |
|---|---|---|---|
| 148147 | 5/1921 | United Kingdom | 91/321 |

OTHER PUBLICATIONS

Speedflow Manufacturing Corp., Technical Data Manual (Unit No. 431-100), Hydraulic Motor Assembly, Sep. 1983.

*Primary Examiner*—Douglas C. Butler
*Assistant Examiner*—Michael J. Forman
*Attorney, Agent, or Firm*—Harlan P. Huebner

[57] ABSTRACT

An improvement in a hydraulic motor for use with an airless paint sprayer system which includes releasable stop means that lock a spool means within said motor to a surrounding sleeve which stop means signal the end of upper and lower strokes of a reciprocating piston associated with said sleeve. In addition, hydraulic fluid anti shock means are provided to prevent the rupture of outlet filter means.

11 Claims, 7 Drawing Sheets

FIG. 1.
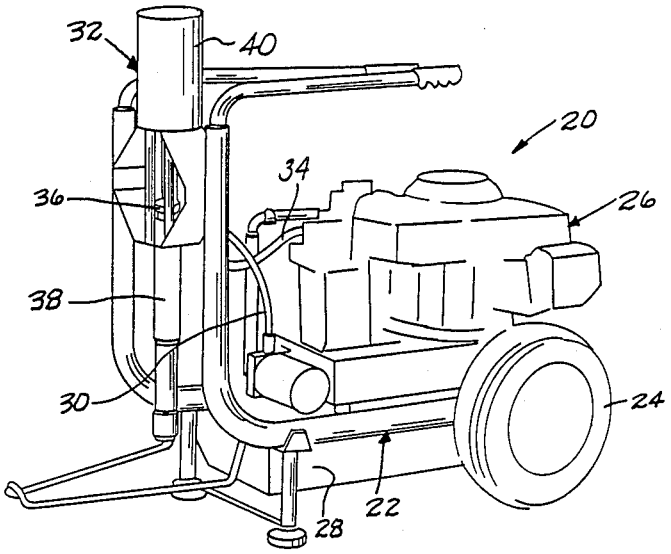
FIG. 11.
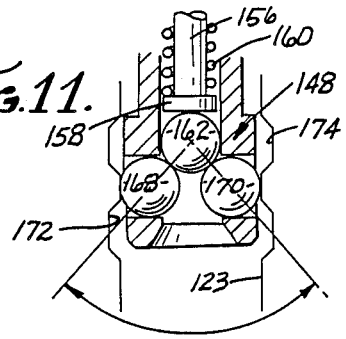
FIG. 8.
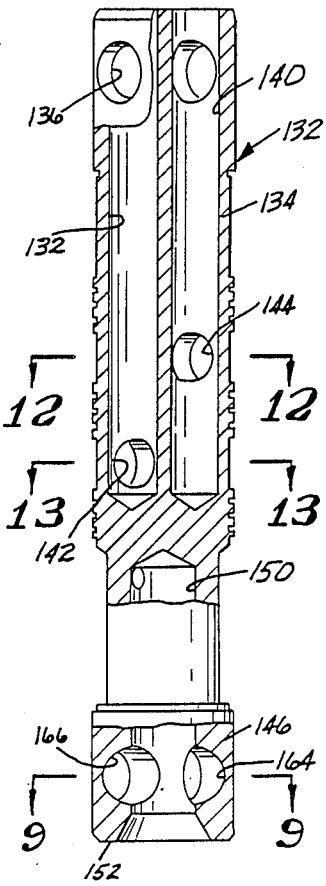
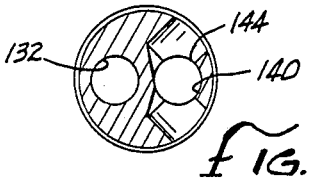
FIG. 12.
FIG. 10.
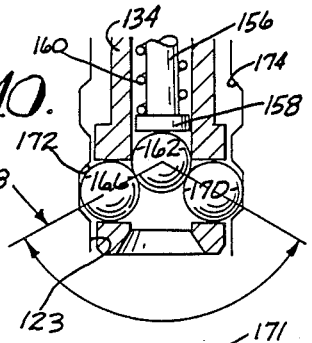
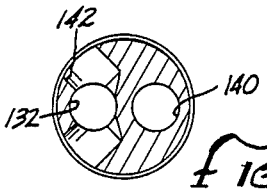
FIG. 13.
FIG. 9.
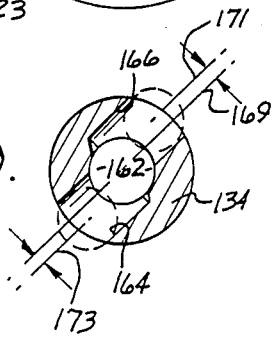

HYDRAULIC MOTOR FOR USE WITH AIRLESS PAINT SPRAYER SYSTEM

BACKGROUND OF THE INVENTION

1. Field of the Invention

The present invention relates to improvements in a hydraulic motor for coupling to a reciprocating piston type of pump. Such motors and pistons generally are applied to a variety of uses, for example to supply slurries of paint or other coating compositions to spray heads for an airless paint sprayer.

2. Description of the Prior Art

Hydraulic motors for use with reciprocating pistons for airless paint sprayers have been used in the past. An illustration of such a hydraulic motor is manufactured by Speedflo. While such a motor is hydraulically actuated and coupled to a piston the internal reciprocating motor piston within the motor employs a single stop means that causes a binding of the parts.

The Speedflo hydraulic motor utilizes a single spring loaded ball that moves horizontally into detents or grooves in the spool. Such construction has the disadvantage of urging the spool and in turn the piston sideways or angled from the vertical at the area of detent engagement. Such angulation will cause the wear.

The wear of such a device as the Speedflo unit is greatly increased with the reciprocation of the piston against the cylinder wall and requires frequent servicing.

In addition, the Speedflo hydraulic motor has a tendency to dislodge filters in the area of where the hydraulic fluid moves from the hydraulic motor to the reservoir due to fluid shock at the upward and downward stroke of the piston.

In addition, there is no known bleeder means for hydraulic motors that can be employed to unfreeze such a motor should the piston become frozen due to foreign matter in the fluid.

SUMMARY OF THE INVENTION

According to the present invention means are provided in a hydraulic motor for use with an airless paint sprayer to assure a releasable stop means to hold a hydraulic motor piston in one of two positions where there is an even distribution of weight and the spool or piston therein will not wear unevenly when operating.

Another advantage of the present invention is to provide a hydraulic motor with a releasable stop means of balls and grooves wherein the construction of the same will assure a rotation of the balls to prevent uneven wear on the same.

A still further object of the present invention is to provide a fluid anti-shock hydraulic fluid rservoir means within the hydraulic motor to ease the pressure shock of the fluid as the reciprocating piston is moved up and down.

Another object is to provide a bleeder means to ease pressure on the piston and release the same should the same freeze during operation.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which:

FIG. 1 is an environmental view of an airless paint sprayer with a hydraulic motor included;

FIG. 8 is a detailed partial section view of a spool containing portions of a releasable stop means for engaging and maintaining the piston in upper or lower position;

FIG. 9 is a cross sectional view taken on line 9—9 of FIG. 8;

FIGS. 10 and 11 are illustrations of ball retaining means of the releasable stop means in locking position and moving from one locking position to another;

FIG. 12 is a cross sectional view of hydraulic inlet port means taken on line 12—12 of FIG. 8; and FIG. 13 is a cross sectional view of hydraulic outlet port means taken on line 13—13 of FIG. 8.

DETAILED DESCRIPTION OF THE PREFERRED EMBODIMENT

Figure 2:
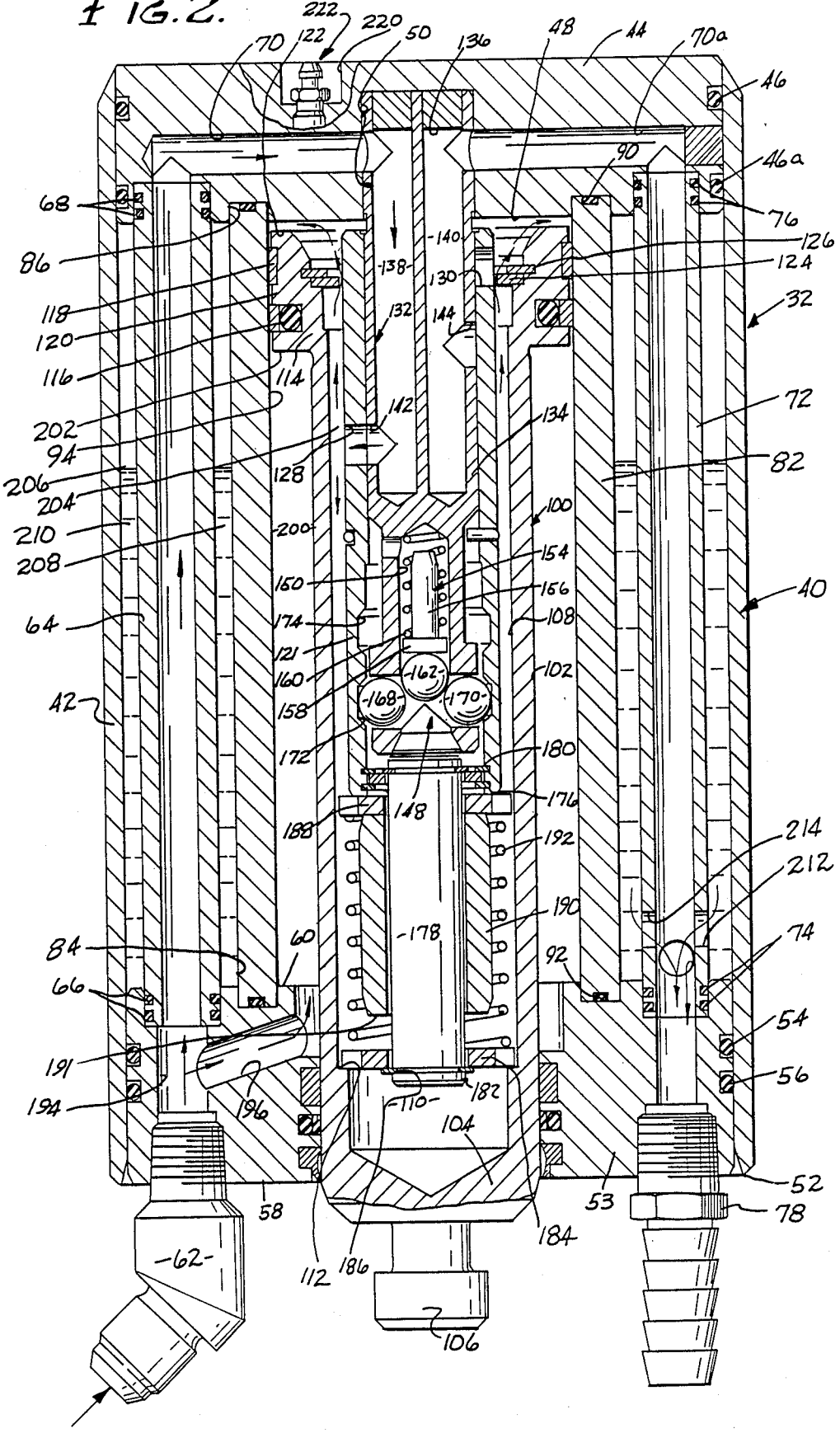
FIG. 2 is a cross sectional view of a hydraulic motor with the interior reciprocating piston at the top of its stroke.

In FIG. 1 there is illustrated an airless paint sprayer system generally designated 20. There is a frame 22 mounted on wheels 24. Mounted on the frame 22 is an engine generally designated 26 to move hydraulic fluid from a hydraulic fluid tank 28 through pressure hose 34 to a hydraulic motor generally designated 32. There is also an outlet hose 30 to pass the hydraulic fluid from the hydraulic motor 32 back to the tank 28.

To further orient the matter, connected to the hydraulic motor 32 by a coupling 36 is a paint piston rod plunger 38 for reciprocation. The piston 38 sits in a container of paint (not shown) resting on the frame 22 and conventionally moves the paint to a sprayer head for discharge.

The thrust of the present invention resides in structure inside the hydraulic motor 32 and the remaining description will be confined thereto.

The hydraulic motor 32 includes a housing 40 which is preferably cylindrical and includes an annular wall 42 with an upper end plate 44 to close the top. O sealing rings 46 and 46A are positioned in the plate 44 to prevent leakage. In addition, formed within the plate 44 on the underside 48 is a spool seat bore 50 which extends inward from the underside 48.

At the bottom 52 of the housing 40 is a lower end plate 53 to close the bottom of the housing. There are O ring seals 54 and 56 to prevent leakage. The plate 53 includes an outer end surface 58 and inner end surface 60.

The end plate 53 is fitted with an inlet hose coupling 62 to receive inlet hose 34 where hydraulic fluid is pumped. The fluid enters an inlet tube 64 that communicates with coupling 62 and extends upward being seated in the upper end plate 44. Sealing rings 66 and 68 are employed around the inlet tube 64. The fluid will then pass into a horizontal bore 70 which extends across the plate with a bore section 70A communicating with an outlet tube 72 similar to the tube 64. Again O rings 74 and 76 are employed to seal the tube 72. The outlet tube 72 communicates with an outlet hose coupling 78 to which is connected the outlet hose 30 back to the fluid tank 28.

A filter shown in FIG. 1 is interposed between the coupling 78 and outlet hose 34 to clean the hydraulic fluid.

Inwardly of the two tubes 64 and 72 a cylinder 82 is positioned between the end plates 44 and 52. The cylinder 82 is seated in respective annular upper and lower grooves 84 and 86 and O rings 90 and 92 are employed to seal the cylinder. The cylinder 82 has an inner surface 94.

Mounted within the cylinder 82 is a reciprocating piston generally designated 100 that includes an elongated hollow core 102 which passes out the end plate 53. At the bottom of the core 102 there is an end portion 104 that is closed. Projecting from the end 104 is knob 106 for use in coupling the piston 100 with the piston rod plunger 38 of a pump, which coupling forms no part of the present invention.

The core 102 includes an inner annular surface 108. Adjacent the bottom portion 104 there is a cutout 110 which is smaller in diameter than the surface 108 so that an annular shoulder 112 is formed.

The piston 100 at the upper end includes a larger diameter head portion or piston heads 114 that extends to the inner surface 94 of the cylinder and will ride up and down in the cylinder 82. Sealing rings 116 and 118 extend around the facing surface 120 of piston head 114 to prevent fluid from passing around the piston head portion 114.

Adjacent the upper end 122 of the piston head 114 is an annular stop ring 124 held in place by retainer ring 126.

A floating sleeve 121 includes an inlet fluid passage or port 128 on one side of the sleeve 121 and above and on an opposite side there is an outlet passage or port 130.

Permanently mounted to upper end plate 44 is a spool means generally designated 132, see FIG. 8. The spool means includes a spool cylindrical rod 134 that has an upper end seated in spool seat 50. Adjacent the seated position are hydraulic fluid bores 136 which passes through the diameter of the rod 134 and communicate with the horizontal fluid bores 70 and 70A in the upper end plate 44.

The rod 134 is provided with vertical inlet and outlet fluid bores 138 and 140 respectively that extend downward from bores 136 to a position slightly below an inlet fluid port 142 that can communicate with inlet port 128 and the vertical bore 108. On the other side of rod 134 communicating with vertical outlet bore 140 is a fluid outlet port 144. This port 144 will on certain positions of the stroke communicate with outlet port 130 in sleeve 121.

At the lower end 146 of spool rod 134 are part of releasable stop means generally designated 148. The stop means 148 are to releasably lock the spool means 132 with the sleeve 121 in two positions. The two positions represent the up and down stroke of the piston 100.

The stop means 148 include a vertical ball bore 150 extending inwardly from end 152. Mounted within the bore 150 is ball biasing means 154 which is preferably a pin 156 with a flat ball engaging head 158. The pin is biased downwardly by spring 160 and the head 158 bears against ball 162, see FIGS. 10 and 11.

Mounted below ball 162 in opposed offset bores or races 164 and 166 are a pair of locking balls 168 and 170. As can be seen in FIG. 9 there is a center line 169 that passes through the diameter of cylindrical rod 134, but the center lines 171 and 173 of the biased balls 168 and 170 and their respective bores 164 and 166 are offset from line 169. The purpose of such structure will be subsequently explained.

With the downward pressure of spring 160 on head 158 ball 162 is urged downward and as can be seen ball 162 being centered in the rod 134 will contact both locking balls 168 and 170 on the top right and left quadrant respectively equally urging them horizontally outward in the races where they will be seated in a lower annular ball groove 172 or upper annular ball groove 174 formed in the sleeve 121.

When the locking balls 168 and 170 are in the groove 172 the sleeve 121 is locked against upward or downward movement.

Figure 6:
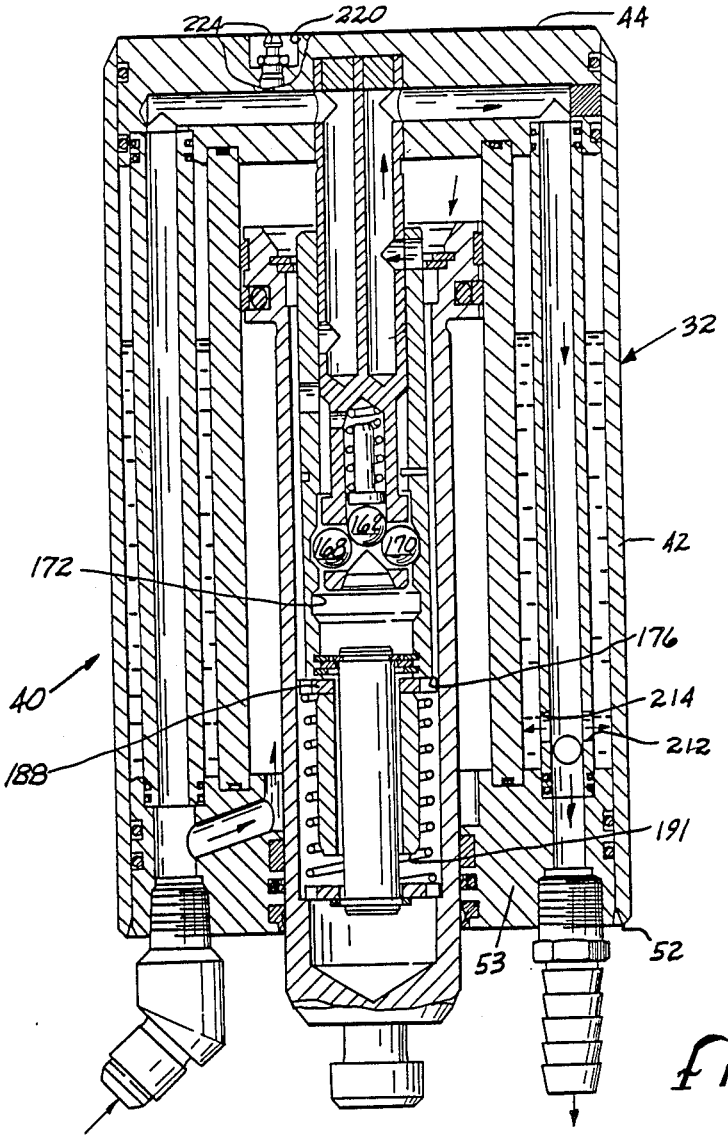

Above groove 172 is the upper annular ball groove 174 to hold the sleeve 121 in its upper stroke, see FIG. 6.

Secured to the bottom 176 of sleeve 121 are linking means. The means includes a guide pin 178 by means of retention ring 108. At the bottom 182 of the guide pin 178 is a star washer 184 held in place to the pin by retention ring 186.

Above the star washer 184 near the top of the guide pin 178 is an additional star washer 188 which is loosely fitted around the pin 178. The washer in its at rest position bears against the bottom 176 of sleeve 121.

Extending between the respective star washers 184 and 188 around the pin 178 is an annular spacer 190. The spacer 190 is shorter than the length of the at rest space between washers so that the bottom 191 is actually spaced away from the washer 184. There is a coil spring 192 encircling the spacer 190. the spring 192 urges the star washer 188 upward away from the bottom washer 184 and in the extended or rest position spaces the spacer from the washer 184.

In operation, hydraulic fluid from tank 28, is pumped through coupling 62 in the direction of the arrow, see FIG. 2 upward through bore 194 in end plate 53 to either the tube 64 or through a bypass bore 196 in the plate 53 that angularly extends between bore 194 and the annular space 200 between cylinder 82 and piston 102.

Taking the FIG. 2 diagram as a start, the piston 100 is at the top of the stroke with very little space between the upper end 122 of piston head 114 and the underside 48 of upper end plate 44. The fluid from annular space 200 will pass back out the bypass bore 196 and up the tube 64 into the horizontal bore 70. As the bore 70 communicates with bore 138 in spool means 132 the hydraulic fluid will pass downward in bore 138 and pass outward through fluid port 142 in spool means 138 and passage 128 in the sleeve 121 because at that point in the stroke the port 142 and passage 128 are aligned.

The hydraulic fluid then moves into annular space 204 upward between annular stop ring 124 and the sleeve 121 into the space or area above the top of the piston head 114.

The fluid as it passes from passage 128 may also move downward forming hydraulic pressure on the bottom of piston hollow core 110.

Figure 3:
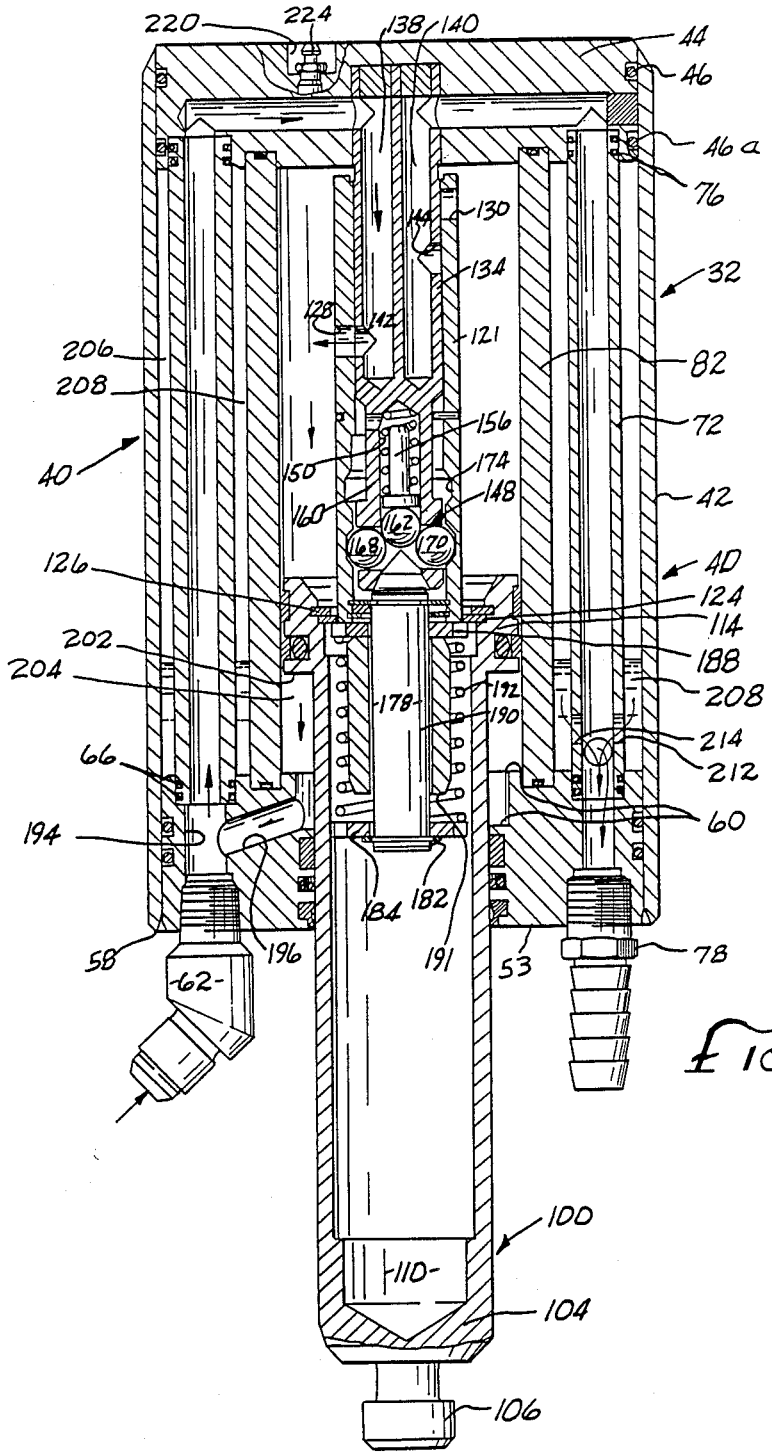
FIGS. 3 through 7 are cross sectional views of the hydraulic motor of FIG. 2 illustrating downward movement of the piston on its downward stroke, FIGS. 3 and 5 and illustrating upward movement of the piston on its upward stroke, FIGS. 6 and 7.

As the fluid is continued to be pumped the pressure thereof on the piston head 114 will commence moving the reciprocating piston 100 downward within the cylinder 82, see FIG. 3, where the piston will commence moving out of the housing 40. At this point the sleeve 121 is still fixed in an upper position with the cylindrical rod 134 of spool means 132.

Figure 4:
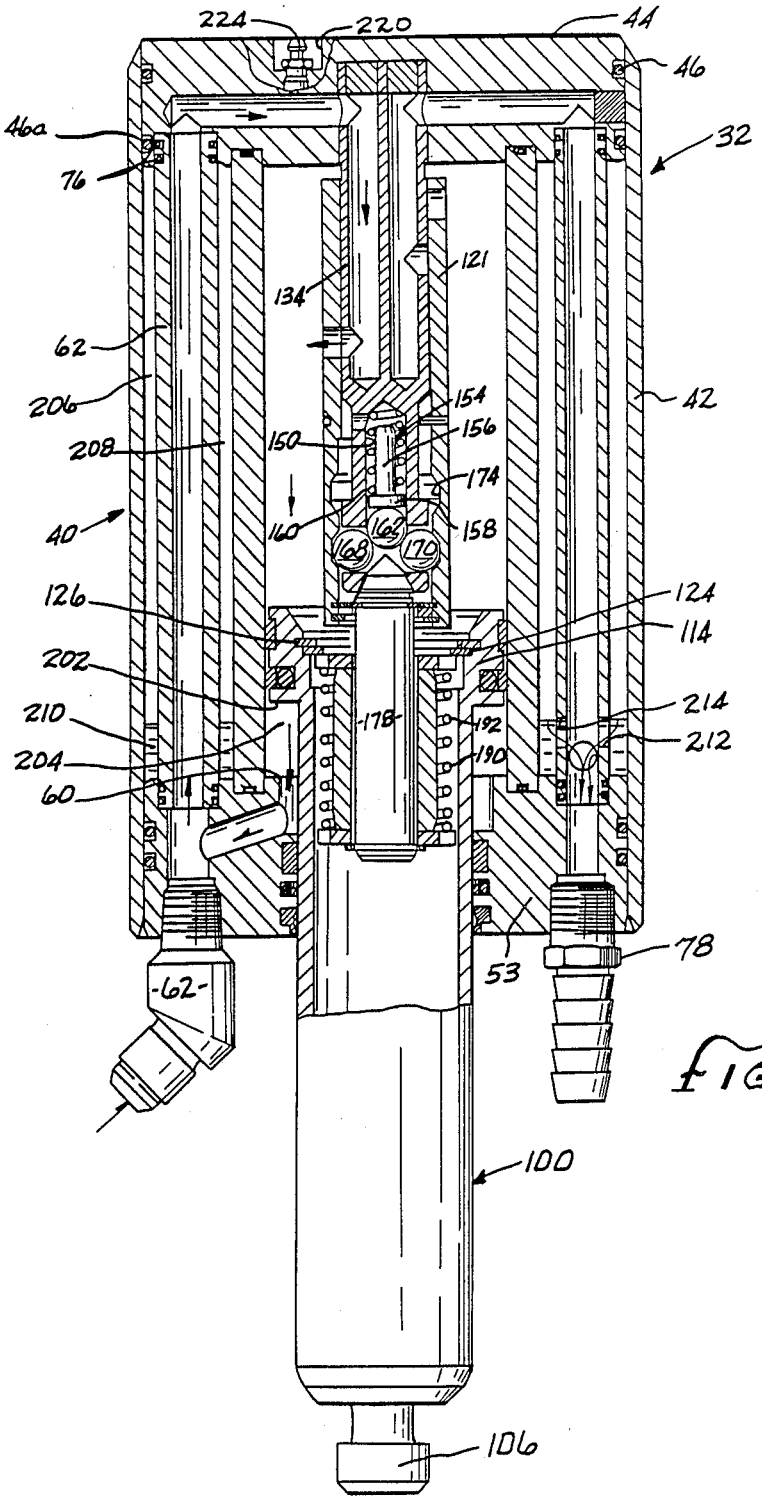

With the continued downward movement of the piston 100 several things happen. Fluid in space 204 will continue to move out and circulate to place downward pressure on the piston head 114 and piston bottom 110. In addition, the anti-shock reserve fluid 210 will pass out opposed discharge openings 212 and 214 into outlet tube 72 and back to the tank 28. This allows the piston 100 to move from the upper position in FIGS. 2 downward to a position in FIG. 3 where the annular stop ring 124 of the piston 100 engages the star washer 188. At this point the upper star washer 188 and spring 192 are compressed until the bottom 191 of spacer 190 bottoms out on the bottom washer 184, see FIG. 4. This will then cause the piston 100 and sleeve 121 to become a solid unit to move downwardly together as a single entity. As the sleeve 121 moves downward pressure will be placed on the balls 168 and 170 in the annular groove 172 to move them inward toward each other. This in turn will cause upward pressure on equalizer ball 162 against pin 156 and spring 160 and the balls 168 and 170 will commence moving horizontally out of the groove. In FIG. 10 it can be seen the vertical center line angles between ball 162 and 168 and 162 and 170 are illustrated by the arcuate arrow. The triangulated angle is relatively shallow as the equalize ball 162 is urging balls 168 and 170 away from it.

In addition, with the openings 164 and 166, FIG. 9 offset from the center diameter line 169 or off center illustrated by the space between arrows in FIG. 9, the balls therein upon movement will rotate. By rotation on each reciprocal thrust of the piston 100, usual wear to the balls is prevented and equal pressure is always asserted to maintain the reciprocation without undue binding and wearing of the parts.

Further, with the use of a flat head 158 of pin 156 there is only a minimum contact with the round surface of the ball 162. This again will prevent undue wear on the equalizer ball 162 and assure proper equalized engagement of balls 168 and 170 and thus equal pressure movement into either stop groove 172 or 174.

Figure 5:
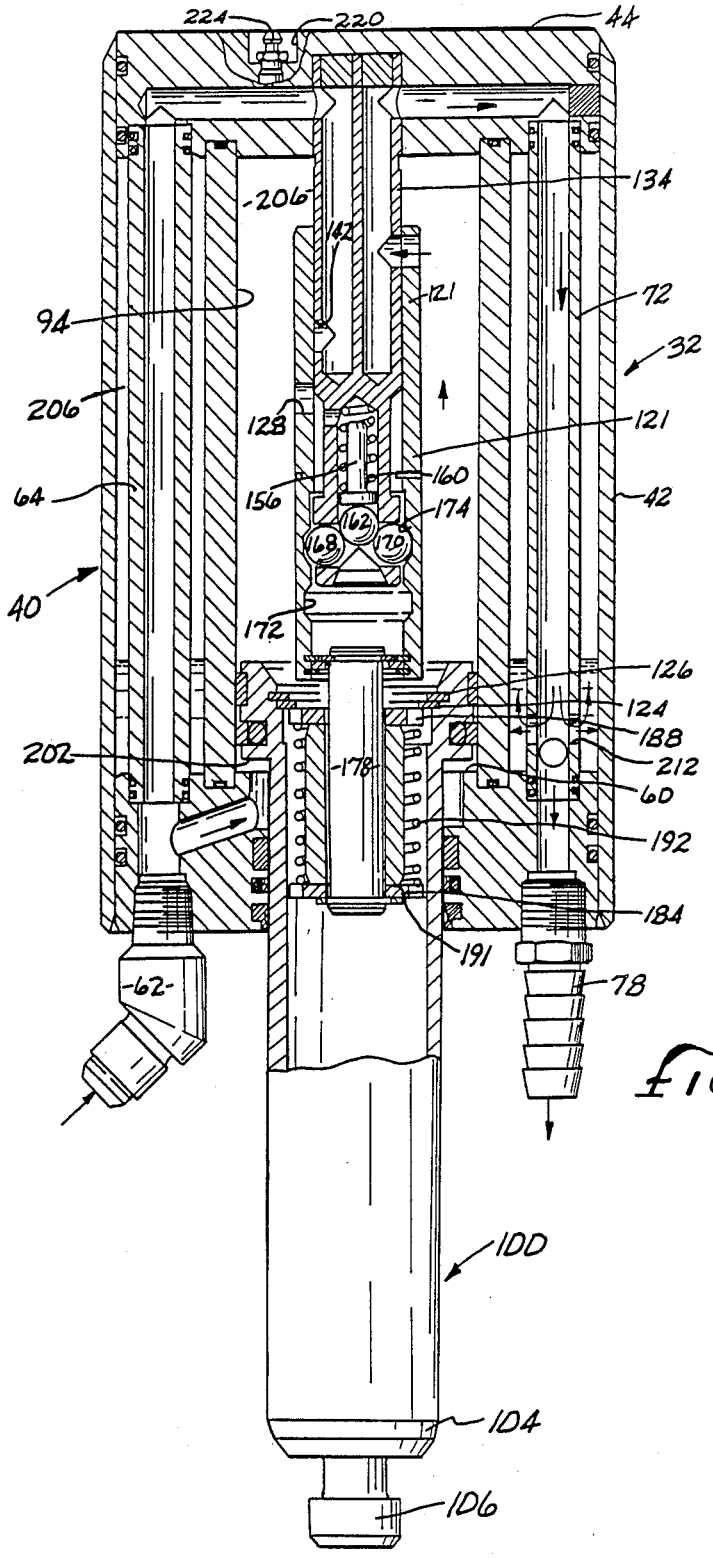

As horizontal pressure is continued to be exerted by the downward or upward movement of sleeve 121 the combined sleeve 121 and piston 100 will continue downward and the balls 168 and 170 ride on the interior surface 123 until they are urged outwardly into the upper groove 174 as seen in FIG. 5 and the sleeve 121 and spool 132 are again locked together.

The FIG. 5 position is actually the bottom of the stroke and at that point discharge passage 130 and discharge fluid port 144 are in registry and inlet port 142 and passage 128 are out of registry. This will allow hydraulic fluid in space 204 to pass out into discharge bore 140, port 70*a* in plate 44 to and down discharge tube 72.

At the point of shown in FIG. 5 the hydraulic fluid for the most part will exit discharge openings 212 and 214 to rebuild the anti-shock reservoir 210 and not pass to the tank 28.

Figure 7:
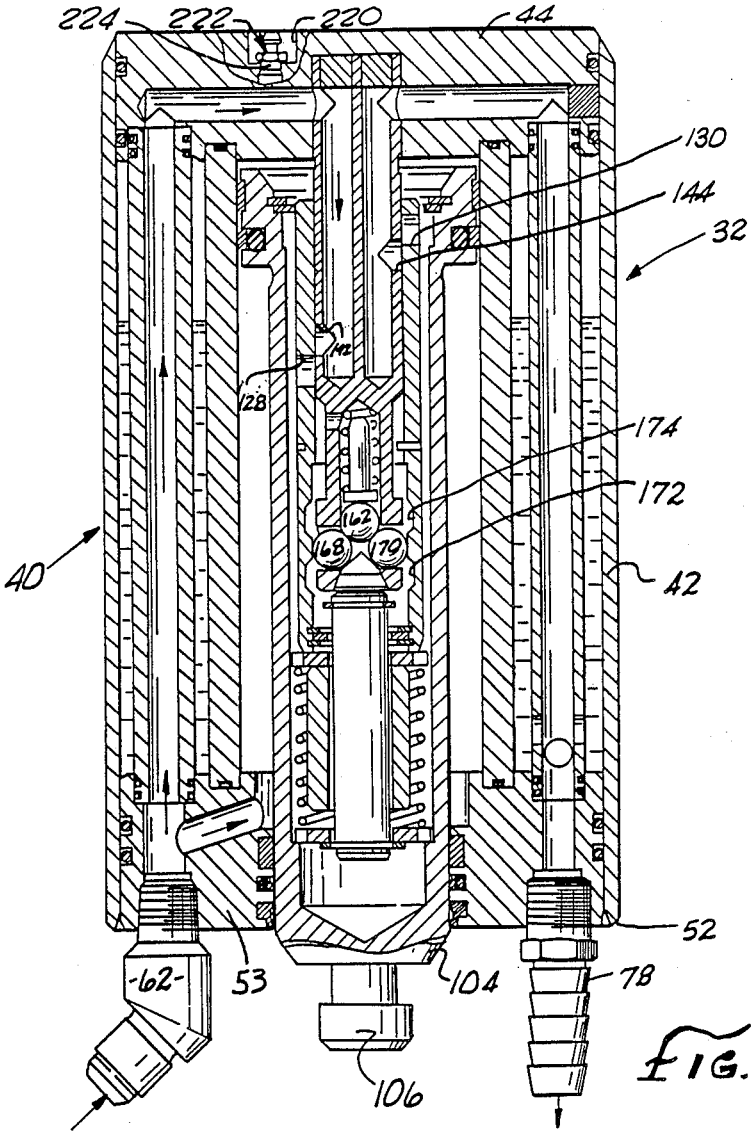

In addition, hydraulic fluid will pass through bypass bore 196, see arrows in FIG. 6 and bear against the under portion 202 of head 114 to commence moving the piston 100 back into the housing to position showed in FIG. 6, where the shoulder 112 engages the bottom star washer 184, compressing the spring 192 until both star washers and spacer 190 becomes a solid unit and star washer 188 will bear against the sleeve bottom 176 urging the sleeve 121 upward. Again, the balls 168 and 170 are urged inwardly against equalizer ball 162 which will give and allow the balls 168 and 170 to equally move horizontally and lock into the lower groove 172. FIG. 7 illustrates the releasable stop means 148 where the balls 168 and 170 are rolling on the inside 123 of the sleeve 121 between the upper groove 174 and lower groove 172.

When the locking balls 168 and 170 are in the lower annular groove 172 the top of the stroke is reached and the inlet fluid port 142 and inlet passage 12 are again in registry for fluid to commence moving the piston 100 back down.

Thus, it can be seen that the piston 100 will reciprocate up and down as hydraulic fluid pressure is applied.

With regard to the anti-shock reservoir 210 of hydraulic fluid its presence with air above will act as a cushion to prevent a surge of fluid that can destroy a filter on the outlet side of the system. The hydraulic motor 32 is usually driven through pressure of between 1000 and 2000 p.s.i. This pressure is considerable and without the fluid reservoir 210 and air above the sudden alignment of exit or outlet passage 130 and exit or outlet port 144 would cause a shock of fluid through the discharge tube 72. The oil reservoir 210 and air will aid in cushioning the shock.

At the top of the upper end plate 44, FIGS. 2 through 7 there is provided a fitting recess 220 into which a bleeder means 222 is mounted. The bleeder means 222 is a bleeder valve 224 which communicates with the space between faces 48 and 122. The main use for this bleeder means 222 is where the respective inlet port and passage 128 and 142 and the respective exit or outlet port and passage 130 and 144 are not in alignment, see FIG. 7. At one point in the reciprocation such non-alignment occurs. It has been found that should foreign matter be in the hydraulic fluid, the piston 100 could freeze up at the FIG. 7 position. With the special bleeder valve 224 enough pressure by way of bleeding of hydraulic fluid can take place that the piston 100 will move up so proper respective alignment occurs and the stroke continues.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. An airless paint sprayer system including an engine to pump hydraulic fluid from a tank to a hydraulic motor having a hydraulic system therein with fluid inlet and fluid outlet tubes therein and a paint piston rod plunger suspended therefrom to be placed in a container of paint and reciprocated thereby moving paint through appropriate hoses to a paint discharge spray nozzle, the improvements in said hydraulic motor including:

a housing including an upper closed end portion and a lower closed end portion, said lower closed end portion having a centrally formed piston receptive passage extending therethrough wherein said passage communicates with the interior of said housing;

a spool means fixedly mounted in said upper closed end portion and suspended within said housing;

a slidable sleeve encasing said spool means adapted to move up and down on said spool means;

a reciprocating hydraulic fluid actuated piston mounted within said housing, extending through said piston receptive passage within said lower closed end portion, said piston surrounds said slidable sleeve and spool means and is capable of moving on an upward and downward stroke during reciprocation;

a piston cylinder extending between said upper and lower closed end portions surrounding said reciprocating piston and encasing the same whereby a hydraulic fluid chamber is created therein that communicates with said hydraulic system and fluid therein will cause reciprocation of said piston;

cooperating releasable stop means associated with said spool means and said sleeve adapted to releasably retain said sleeve in one of two locked positions and define the end of each of said upward and downward strokes of said piston; and linking means suspended from said slidable sleeve which has an at rest position where no linking occurs, and a linked position caused by the downward movement of said piston, when said piston engages a portion of said linking means whereby said linked position causes simultaneous movement of said slidable sleeve and said piston.

2. In an airless paint sprayer system as defined in claim 1 wherein said spool means and said slidable sleeve includes pairs of registerable hydraulic fluid inlet ports and hydraulic fluid outlet ports for the passage of hydraulic fluid in said system to and from said spool means to said hydraulic fluid chamber to regulate the reciprocating movement of said piston.

3. In an airless paint sprayer system as defined in claim 1 wherein there is included:

bleeder means associated with said spool means and said spool means and said slidable sleeve means in said hydraulic system adapted to bleed fluid and to free the movement of said slidable sleeve should the same become frozen during operation.

4. In an airless pain sprayer system as defined in claim 3 wherein said bleeder means is a valve adapted to be opened and bleed fluid and reduce the pressure thereof.

5. In an airless paint sprayer system as defined in claim 1 said cooperating releasable stop means includes:

a pair of opposed locking balls mountd in a pair of horizontally offset races formed in said spool means whereby the locking balls may extend horizontally beyond said spool means;

a vertical equalizer ball bore formed in said spool means above and communicating with said pair of offset races;

an equalizer ball slideably mounted in said bore above said pair of opposed locking balls and engaging each of said locking balls with equal pressure;

biasing means within said vertical equalizer ball bore urging said equalizer ball against said locking balls whereby said locking balls are urged horizontally outward; and locking means in said slidable sleeve engagable by said pair of locking balls where the space between said locking balls allows the equalizer ball to ride in a first at rest position, yet said pair of balls is yieldable out of said locking means against said equalizer ball for travel of said sleeve vertically from said spool means with the space between said locking balls becoming less than said first named space and said equalizer ball riding higher on said locking balls than in said at rest position and said equalizer ball overcoming said biasing means to move in said bore.

6. In an airless paint sprayer system as defined in claim 5 wherein said biasing means includes:

a pin in said vertical equalizer ball bore including a flat head, and said head engaging said equalizer ball; and a coil spring surrounding said pin in said bore urging said pin and in turn said equalizer ball downward.

7. In an airless paint sprayer system as defined in claim 5 wherein:

said pair of horizontal offset races are each offset on either side of a diameter line through said equalizer ball whereby upon engagement said locking balls with rotate to assure even wearing thereof.

8. In an airless paint sprayer system as defined in claim 5 wherein:

said locking means include a pair of vertically spaced annular grooves in said slidable sleeve whereby said grooves define the position of locking the piston in either of said upper and downward stroke.

9. In an airless paint sprayer system as defined in claim 8 wherein:

said grooves are chamfered at the edges to produce a taper whereby the dislodgement of said locking balls from one groove for movement into the other groove are rendered relatively easy.

10. In an airless paint sprayer system as defined in claim 1 wherein:

a fluid anti-shock hydraulic fluid reservoir is included in said housing to absorb the shock of the pressure of said hydraulic fluid when the same is introduced to said outlet bores; and ports are positioned within said fluid outlet tube of said system to feed fluid in different amounts into said housing dependent upon the stroke position of said piston.

11. A hydraulic motor for use in an airless paint sprayer system wherein said motor is connectable to a paint piston rod pluger adapted to move paint from a container to an area for painting, said motor including:

a housing including an upper closed end portion and a lower closed end portion, said lower closed end portion having a centrally formed piston receptive passage extending therethrough wherein said passage communicates with the interior of said housing;

a spool means fixedly mounted in said upper closed end portion and suspended within said housing;

a slidable sleeve encasing said spool means adapted to move up and down said on spool means;

a reciprocating hydraulic fluid actuated piston mounted within said housing, extending through said piston receptive passage within said lower closed end portion, said piston surrounds said slidable sleeve and spool means and is capable of moving on an upward and downward stroke during reciprocation;

a piston cylinder extending between said upper and lower closed end portions surrounding said reciprocating piston and encasing the same whereby a hydraulic fluid chamber is created therein that communicates with said hydraulic system and fluid therein will cause reciprocation of said piston;

cooperating releasable stop means associated with said spool means and said sleeve adapted to releasably retain said sleeve in one of two locked positions and define the end of each of said upward and downward strokes of said piston; and linking means suspended from said slidable sleeve which has an at rest position where no linking occurs, and a linked position caused by the downward movement of said piston, when said piston engages a portion of said linking means whereby said linked position causes simultaneous movement of said slidable sleeve and said piston.

* * * * *